US010662536B2

(12) United States Patent
Nagai

(10) Patent No.: US 10,662,536 B2
(45) Date of Patent: May 26, 2020

(54) CONTINUOUS ANNEALING EQUIPMENT

(71) Applicant: PRIMETALS TECHNOLOGIES JAPAN, LTD., Hiroshima-shi, Hiroshima (JP)

(72) Inventor: Takanori Nagai, Hiroshima (JP)

(73) Assignee: PRIMETALS TECHNOLOGIES JAPAN, LTD., Hiroshima-Shi (JP)

( * ) Notice: Subject to any disclaimer, the term of this patent is extended or adjusted under 35 U.S.C. 154(b) by 195 days.

(21) Appl. No.: 15/756,685

(22) PCT Filed: Aug. 19, 2016

(86) PCT No.: PCT/JP2016/074176

§ 371 (c)(1),
(2) Date: Mar. 1, 2018

(87) PCT Pub. No.: WO2018/033994

PCT Pub. Date: Feb. 22, 2018

(65) Prior Publication Data

US 2018/0245222 A1 Aug. 30, 2018

(51) Int. Cl.

| | |
|---|---|
| ***C21D 9/56*** | (2006.01) |
| ***C23G 3/02*** | (2006.01) |
| ***F27D 17/00*** | (2006.01) |
| ***F27B 9/28*** | (2006.01) |

(Continued)

(52) U.S. Cl.

CPC ..... *C23G 3/025* (2013.01); *C21D 9/56* (2013.01); *C21D 9/562* (2013.01); *C23G 3/021* (2013.01); *C23G 3/027* (2013.01); *C23G 3/028* (2013.01); *F27B 9/28* (2013.01); *F27B 9/3005* (2013.01); *F27D 17/004* (2013.01); *C23G 1/19* (2013.01); *F27D 17/002* (2013.01)

(58) Field of Classification Search

CPC ..... C21D 9/56

See application file for complete search history.

(56) References Cited

U.S. PATENT DOCUMENTS

2018/0245222 A1* 8/2018 Nagai ..... C21D 9/562

FOREIGN PATENT DOCUMENTS

| | | | |
|---|---|---|---|
| CN | 201753361 | U | 3/2011 |
| CN | 202482387 | U | 10/2012 |
| CN | 104344739 | A | 2/2015 |

(Continued)

OTHER PUBLICATIONS

International Search Report of PCT/JP2016/074176 dated Oct. 25, 2016.

(Continued)

*Primary Examiner* — Scott R Kastler

(74) *Attorney, Agent, or Firm* — Birch, Stewart, Kolasch & Birch, LLP

(57) ABSTRACT

Continuous annealing equipment (1) including a cleaning device (11, 12) for performing a cleaning treatment on a steel strip (S) and an annealing device (12) for performing an annealing treatment on the steel strip (S) comprises an exhaust gas passage (31, 41) through which an exhaust gas discharged from the annealing device (12) flows, a solution circulation passage (32, 51) through which a cleaning solution used in the cleaning device (11, 12) circulates, and a heat exchanger (53) which forms a part of the solution circulation passage (32, 51) and contacts with the exhaust gas.

9 Claims, 6 Drawing Sheets

(51) Int. Cl.
*F27B 9/30* (2006.01)
*C23G 1/19* (2006.01)

(56) References Cited

FOREIGN PATENT DOCUMENTS

| | | | | | |
|---|---|---|---|---|---|
| CN | 205420558 | U | | 8/2016 | |
| JP | 57110625 | A | * | 7/1982 | ..... C21D 9/56 |
| JP | 57-150556 | U | | 9/1982 | |
| JP | 59-185793 | A | | 10/1984 | |
| JP | 4-311533 | A | | 11/1992 | |
| JP | 6-49544 | A | | 2/1994 | |
| JP | 7-180096 | A | | 7/1995 | |
| JP | 7-286291 | A | | 10/1995 | |
| JP | 2000-63957 | A | | 2/2000 | |
| JP | 2013-124384 | A | | 6/2013 | |

OTHER PUBLICATIONS

Extended European Search Report dated Apr. 11, 2019 issued in corresponding European Patent Application No. 16913522.5.
International Preliminary Report on Patentability dated Feb. 28, 2019 in corresponding International Application No. PCT/JP2016/074176.

* cited by examiner

CONTINUOUS ANNEALING EQUIPMENT

TECHNICAL FIELD

The present invention relates to continuous annealing equipment including a cleaning device for performing a cleaning treatment on a steel strip and an annealing device for performing an annealing treatment on the steel strip.

BACKGROUND ART

Continuous annealing equipment includes a pre-cleaning device and an annealing device (annealing furnace), and a steel strip fed to the continuous annealing equipment is subjected to a pre-cleaning treatment with the pre-cleaning device, followed by an annealing treatment with the annealing device. The pre-cleaning treatment is to remove oil, iron powder, and other substances adhering to the surface of the steel strip. The steel strip subjected to the pre-cleaning treatment is then uniformly oxidized in the annealing treatment to improve the surface quality.

For instance, the pre-cleaning device includes an alkaline immersion tank storing an alkaline solution. Oil adhering to the surface of the steel strip is removed in the alkaline immersion tank (for instance, see Patent Document 1).

Various cleaning solutions (e.g., alkaline solution) used in such a pre-cleaning treatment can effectively clean the steel strip by keeping the temperature of the cleaning solution at a predetermined temperature.

CITATION LIST

Patent Literature

Patent Document 1: JPH6-49544A

SUMMARY

Problems to be Solved

Conventionally, an exhaust gas discharged from the annealing device is supplied to a boiler, and steam or pressured water generated by the boiler is used to heat a cleaning solution. Unfortunately, the boiler has high equipment and maintenance costs. Moreover, heating the cleaning solution indirectly (through steam or pressured water) results in a low energy efficiency in the continuous annealing equipment.

The present invention was made in view of the above problems, and an object thereof is to keep the cleaning solution at an appropriate temperature with low cost and high efficiency in the continuous annealing equipment.

Solution to the Problems

Continuous annealing equipment according to the present invention to solve the above problem is a annealing equipment including a cleaning device for performing a cleaning treatment on a steel strip and an annealing device for performing an annealing treatment on the steel strip, the continuous annealing equipment comprising; an exhaust gas passage through which an exhaust gas discharged from the annealing device flows; a solution circulation passage through which a cleaning solution used in the cleaning device circulates; and a heat exchanger which forms a part of the solution circulation passage and contacts with the exhaust gas.

Further, a continuous annealing method according to the present invention to solve the above problem is a continuous annealing method for performing an annealing treatment on a steel strip after a cleaning treatment on the steel strip, the method comprising: causing a cleaning solution to be used in the cleaning treatment to pass through a heat exchanger; bringing an exhaust gas used in the annealing treatment into contact with the heat exchanger; and directly heating the cleaning solution by using the exhaust gas as a heat source.

Advantageous Effects

With the continuous annealing equipment according to the present invention, it is possible to keep the cleaning solution at an appropriate temperature with low cost and high efficiency in the continuous annealing equipment.

Further, with the continuous annealing method according to the present invention, it is possible to keep the cleaning solution at an appropriate temperature with low cost and high efficiency in the continuous annealing equipment.

DETAILED DESCRIPTION

Embodiments of the continuous annealing equipment according to the present invention will now be described in detail with reference to the accompanying drawings. It will, of course, be understood that the present invention is not limited to the following embodiments, and various modifications can be made without departing from the spirit of the present invention by, for instance, combining configurations in the respective embodiments.

First Embodiment

Figure 1:
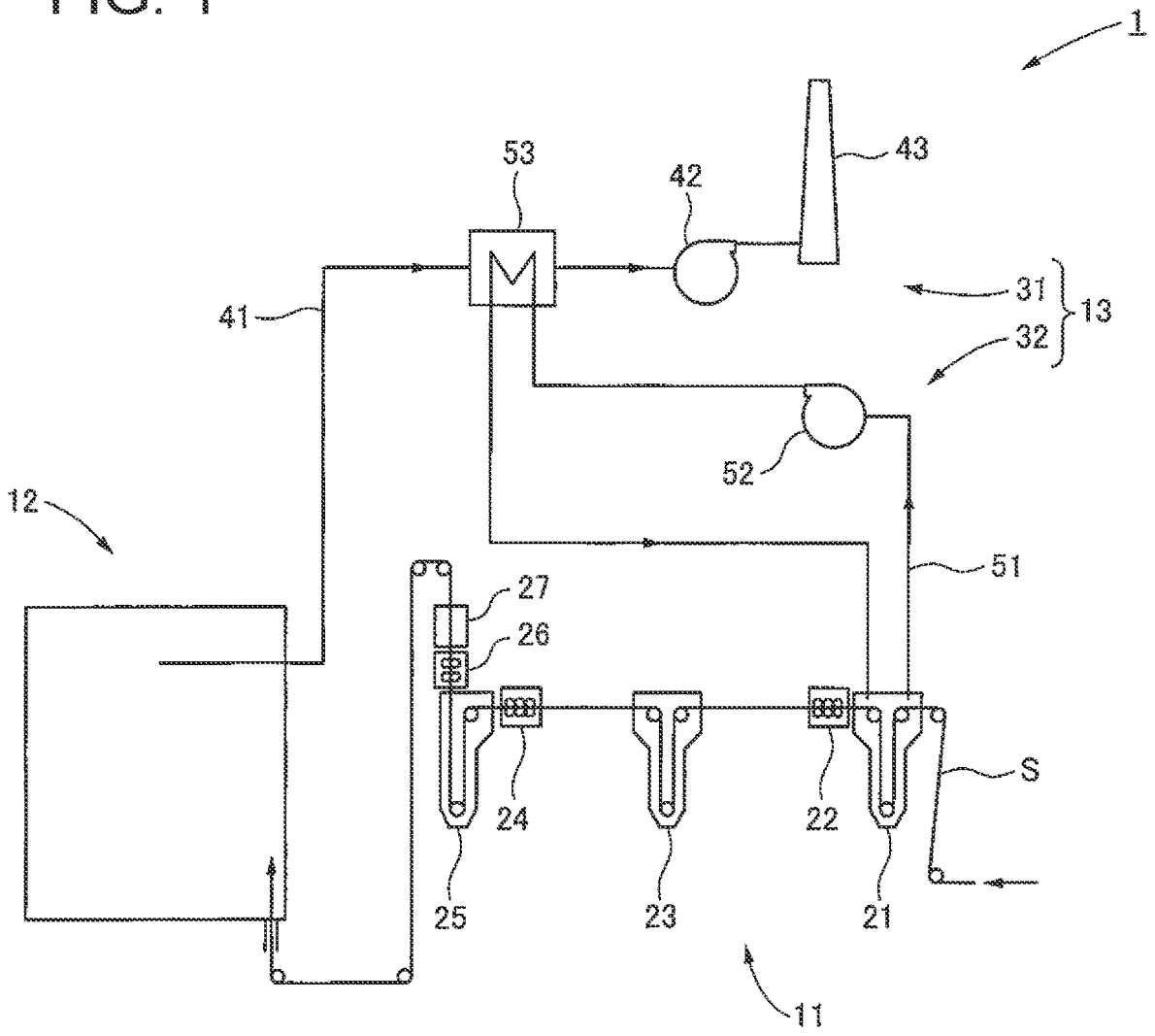
FIG. 1 is an explanatory diagram showing a structure of continuous annealing equipment according to the first embodiment.
Figure 2:
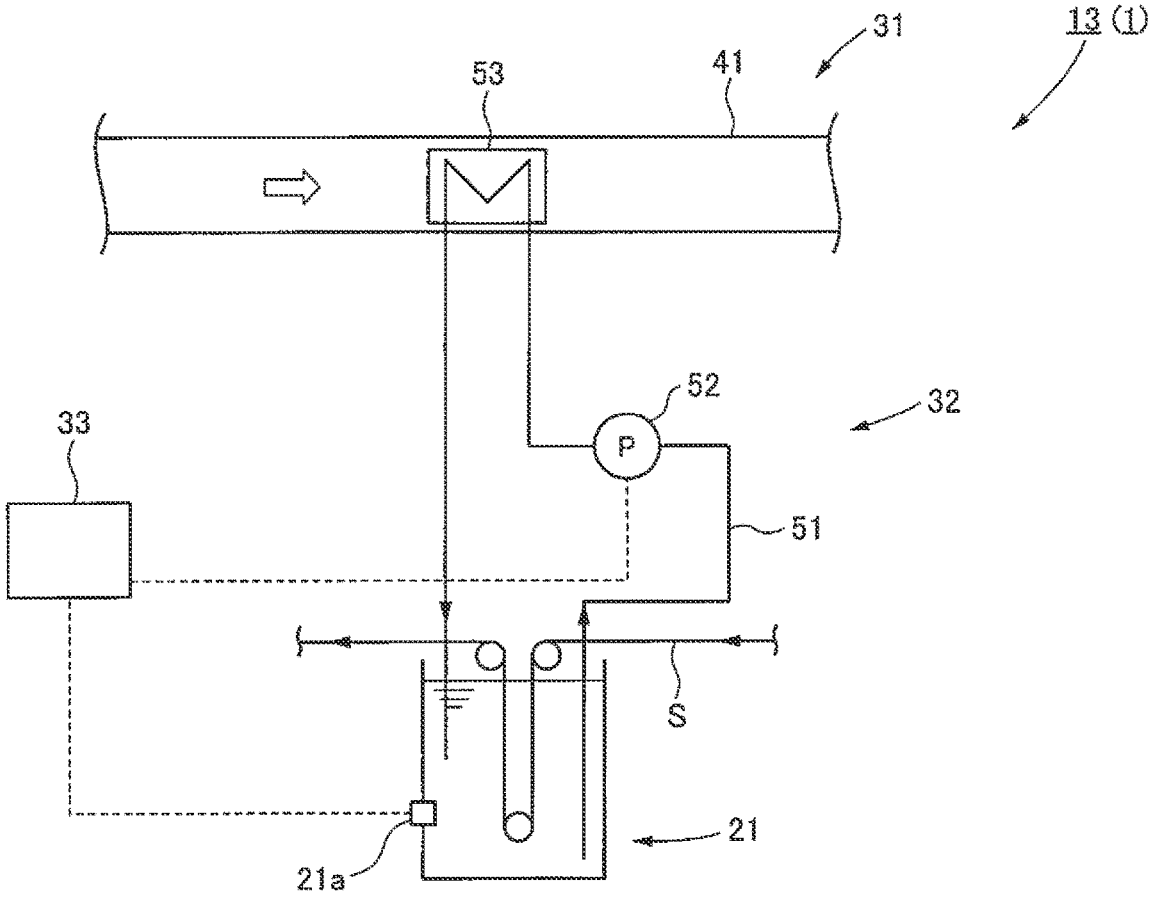
FIG. 2 is an explanatory diagram showing a structure of an exhaust heat recovery device in continuous annealing equipment according to the first embodiment.

With reference to FIGS. 1 and 2, the structure of the continuous annealing equipment according to the first embodiment of the present invention will now be described.

As shown in FIG. 1, continuous annealing equipment 1 includes a pre-cleaning device (cleaning device) 11 for removing oil, iron powder, and other substances adhering to the surface of a steel strip S and an annealing device (annealing furnace) 12 for performing an annealing treatment on the steel strip S cleaned by the pre-cleaning device 11. In the continuous annealing equipment 1, the pre-cleaning device 11 is disposed upstream in the feeding direction, while the annealing device 12 is disposed downstream in the feeding direction.

In the pre-cleaning device 11, an alkaline immersion tank 21 storing an alkaline solution is provided upstream in the feeding direction, and a brush scrubber 22 is provided downstream of the alkaline immersion tank 21 in the feeding direction. The steel strip S is immersed in the alkaline solution in the alkaline immersion tank 21 and then brushed with the brush scrubber 22 to remove oil adhering to the surface.

Downstream of the brush scrubber 22 in the feeding direction, an electrolytic cleaning tank 23 is provided which stores an alkaline solution and contains electrodes (not shown), and a brush scrubber 24 is provided downstream of the electrolytic cleaning tank 23 in the feeding direction. The steel strip S, whose surface is cleaned from oil, passes between the electrodes (not shown) in the electrolytic cleaning tank 23 and then is brushed with the brush scrubber 24 to remove iron powder and other substances adhering to the surface.

Downstream of the brush scrubber 24 in the feeding direction, a rinse tank 25 for spraying rinse water over the fed steel strip S is provided. By spraying the rinse water in the rinse tank 25 over the steel strip S whose surface is cleaned from oil, iron powder, and other substances, the alkaline solutions adhering to the surface through the alkaline immersion tank and the alkaline electrolytic cleaning tank are removed.

Downstream of the rinse tank 25 in the feeding direction, a ringer roll 26 and a dryer 27 are provided. The surface of the steel strip S from which the alkaline solutions are removed is further cleaned from droplets (rinse water) by the ringer roll 26, and the steel strip S is dried by the dryer 27.

The steel strip S subjected to the pre-cleaning treatment in the pre-cleaning device 11 is then fed to the annealing device 12 disposed downstream of the pre-cleaning device 11 in the feeding direction, and is exposed to a high-temperature atmosphere and annealed in the annealing device 12.

As shown in FIG. 1, the continuous annealing equipment 1 includes an exhaust heat recovery device 13 for heating a cleaning solution to be used in the pre-cleaning device 11 (in FIG. 1, the alkaline solution stored in the alkaline immersion tank 21) by using an exhaust gas discharged from the annealing device 12 as a heat source.

The exhaust heat recovery device 13 includes an exhaust gas passage 31 through which the exhaust gas is discharged after the annealing treatment of the steel strip S in the annealing device 12, and an alkaline solution passage (solution circulation passage) 32 through which the alkaline solution stored in the alkaline immersion tank 21 circulates.

The exhaust gas passage 31 includes an exhaust gas tube 41 communicating and connected with the annealing device 12, an exhaust gas fan 42 provided in the halfway of the exhaust gas tube 41, a stack 43 provided at an end (a downstream end in the exhaust gas flow direction) of the exhaust gas tube 41. By driving the exhaust gas fan 42, an exhaust gas of a combustion device (not shown) provided within the annealing device 12 enters the exhaust gas tube 41 and is discharged from the exhaust gas tube 41 to the atmosphere through the stack 43. Herein, the stack 43 represents a smokestack through which the exhaust gas is discharged upward to the atmosphere.

As shown in FIGS. 1 and 2, the alkaline solution passage 32 includes a solution tube 51 communicating and connected with the alkaline immersion tank 21, and a circulation pump 52 and an exhaust gas sensible heat recovery device (heat exchanger) 53 which are provided in the halfway of the solution tube 51. By driving the circulation pump 52, the alkaline solution in the alkaline immersion tank 21 enters the solution tube 51, passes through the exhaust gas sensible heat recovery device 53, and is refluxed into the alkaline immersion tank 21.

Herein, the exhaust gas sensible heat recovery device 53 represents a finned tube heat exchanger, which has a tube (not shown) communicating with the solution tube 51 and functioning as a part of the solution tube 51 and a fin (not shown) extending around the outer periphery of the tube. Additionally, the exhaust gas sensible heat recovery device 53 is disposed inside the exhaust gas tube 41 and contacts with the exhaust gas that flows through the exhaust gas tube 41. Thus, the alkaline solution that passes through the exhaust gas sensible heat recovery device 53 is directly heated (without the support of any other fluid) by heating the exhaust gas sensible heat recovery device 53 with the exhaust gas that flows through the exhaust gas tube 41.

As shown in FIG. 2, the exhaust heat recovery device 13 includes a control device 33 for controlling the temperature of the alkaline solution. The control device 33 is electrically connected with the circulation pump 52 and configured to control an operation of the circulation pump 52.

Additionally, the control device 33 is electrically connected with a temperature sensor 21*a* provided in the alkaline immersion tank 21. Herein, the temperature sensor 21*a* represents a device for detecting the temperature of the alkaline solution in the alkaline immersion tank 21. A detection result (the temperature of the alkaline solution in the alkaline immersion tank 21) detected by the temperature sensor 21*a* is transmitted to the control device 33, and the control device 33 controls an operation of the circulation pump 52, based on the detection result detected by the temperature sensor 21*a*.

With reference to FIGS. 1 and 2, an operation of the continuous annealing equipment according to the first embodiment of the present invention will be described.

In the step of continuous annealing treatment by the continuous annealing equipment 1, first, the steel strip S successively passes through the alkaline immersion tank 21, the brush scrubber 22, the electrolytic cleaning tank 23, the brush scrubber 24, the rinse tank 25, the ringer roll 26, and the dryer 27 in the pre-cleaning device 11 to be subjected to the pre-cleaning treatment (see FIG. 1).

Then, the steel strip S subjected to the pre-cleaning treatment is subjected to the annealing treatment in the annealing device 12 and then fed to equipment (not shown) for a subsequent treatment.

In the step of continuous annealing treatment by the continuous annealing equipment 1, by driving the exhaust gas fan 42, the exhaust gas of the combustion device (not shown) provided within the annealing device 12 enters the exhaust gas tube 41, passes through the exhaust gas sensible heat recovery device 53 disposed in the exhaust gas tube 41, and then is discharged upward to the atmosphere through the stack 43.

Additionally, in the step of continuous annealing treatment by the continuous annealing equipment 1, the control device 33 controls an operation of the circulation pump 52, based on a detection result (the temperature of the alkaline solution in the alkaline immersion tank 21) detected by the temperature sensor 21*a* (see FIG. 2).

More specifically, if the detection result detected by the temperature sensor 21*a* is equal to or more than a predetermined value (for instance, a temperature suitable for alkaline cleaning with the alkaline solution), the control device 33 does not drive the circulation pump 52; whereas if the detection result detected by the temperature sensor 21*a* is less than the predetermined value, the control device 33 drives the circulation pump 52.

Once the control device 33 drives the circulation pump 52, the alkaline solution stored in the alkaline immersion tank 21 enters the solution tube 51 and passes through the exhaust gas sensible heat recovery device 53.

At this time, in the exhaust gas sensible heat recovery device 53, heat is directly (without the support of any other fluid) exchanged between the exhaust gas that flows through the exhaust gas tube 41 and the alkaline solution that flows through the solution tube 51. Then, the alkaline solution heated with the hot exhaust gas is refluxed into the alkaline immersion tank 21.

As described above, the continuous annealing equipment according to the present embodiment allows the alkaline solution stored in the alkaline immersion tank 21 to be directly heated by using the exhaust gas discharged from the annealing device 12 as a heat source, thereby efficiently heating the alkaline solution.

Efficiently heating the alkaline solution enables downsizing of the exhaust gas sensible heat recovery device 53 disposed in the exhaust gas passage 31 (exhaust gas tube 41).

Additionally, since a high-pressure medium such as steam or pressured water is not used, it is unnecessary to use high-pressure vessels, tubes, and the like. Thus, it is possible to prevent the increase in size and equipment cost of the continuous annealing equipment.

The heat exchanger in the present invention is not limited to a heat exchanger (exhaust gas sensible heat recovery device 53) disposed in the exhaust gas passage 31 as in the present embodiment, but may be constituted by providing a jacket, a tube, or the like through which the solution flows, on a wall surface forming the exhaust gas passage.

Additionally, the control device in the present invention is not limited to one that controls the temperature of the alkaline solution by driving or stopping the circulation pump 52 as in the present embodiment, but may control the temperature of the alkaline solution by controlling the pump rotational speed of the circulation pump 52 as well as driving or stopping the circulation pump 52. This configuration allows the discharge amount of the circulation pump 52 to vary in response to changing the pump rotational speed of the circulation pump 52 and thereby adjusts the flow rate of the alkaline solution that passes through the exhaust gas sensible heat recovery device 53. Thus, it is possible to finely adjust the temperature of the alkaline solution.

Additionally, a plurality of circulation pumps 52 (not shown) may be arranged parallel in the alkaline solution passage 32 (solution tube 51), and the control device in the present invention may individually control operations of the plurality of circulation pumps 52. This configuration allows the total discharge amount of the circulation pumps 52 under operation to vary in response to changing the number of the driving circulation pumps 52 under operation and thereby adjusts the flow rate of the alkaline solution that passes through the exhaust gas sensible heat recovery device 53. Thus, it is possible to finely adjust the temperature of the alkaline solution.

Further, a solution-flow-rate adjustment unit capable of adjusting a flow rate of the solution that flows through the heat exchanger may be provided in addition to the circulation pump 52, and the control device in the present invention may control the temperature of the alkaline solution by adjusting the flow rate of the alkaline solution that enters the exhaust gas sensible heat recovery device 53 by means of the solution-flow-rate adjustment unit. Hereinafter, exemplary configurations additionally including the solution-flow-rate adjustment unit will be described with reference to FIGS. 3A and 3B.

Figure 3A:
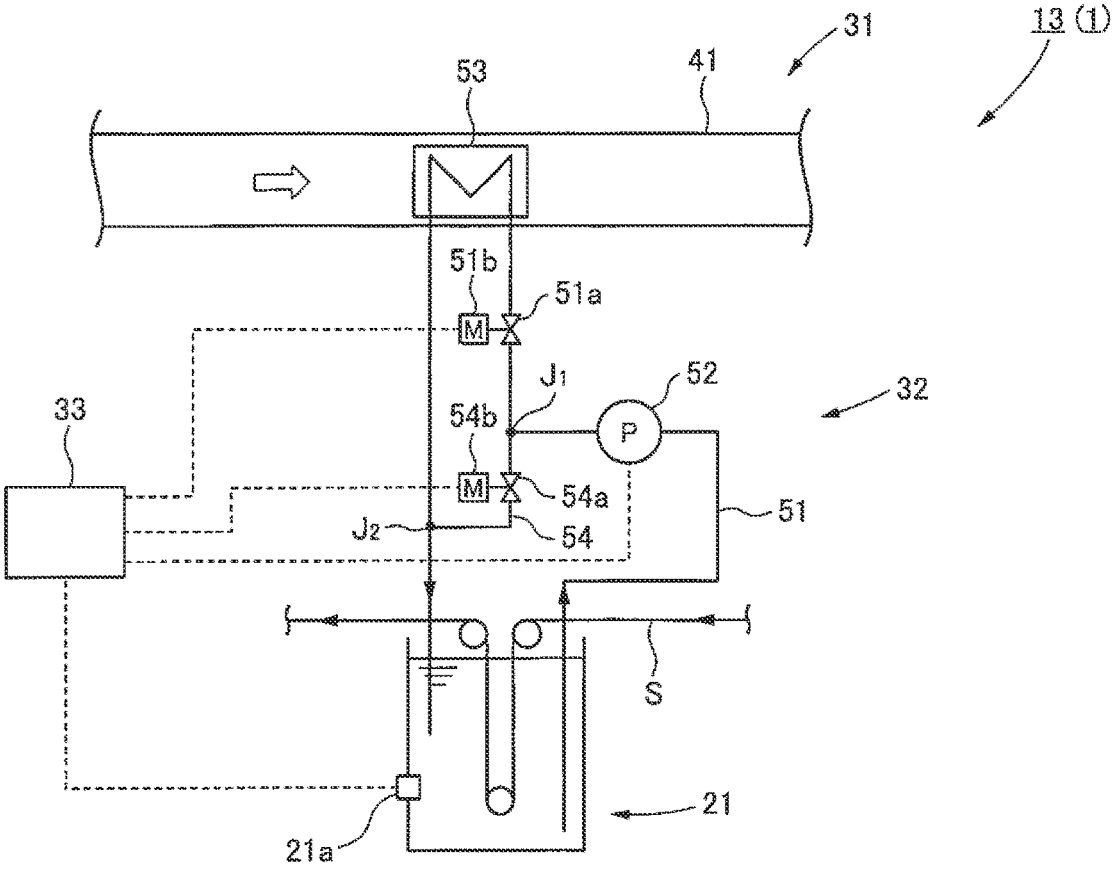
FIG. 3A is an explanatory diagram showing an exemplary configuration in which a solution-flow-rate adjustment unit is provided to an exhaust heat recovery device in continuous annealing equipment according to the first embodiment.

First, in FIG. 3A, the solution-flow-rate adjustment unit is mainly composed of a second solution tube (bypass flow passage) 54 through which the alkaline solution branched from the solution tube 51 can flow, solution-flow-rate adjustment valves 51*a*, 54*a* capable of adjusting the flow passage areas of the solution tube 51 and the second solution tube 54 (the flow rates of the alkaline solutions that flow through the solution tube 51 and the second solution tube 54), and solution-flow-rate adjustment motors 51*b*, 54*b* for operating (opening or closing) the solution-flow-rate adjustment valves 51*a*, 54*a*.

The second solution tube 54 has one end connected with a branch point $J_1$ between the circulation pump 52 and the exhaust gas sensible heat recovery device 53 in the solution tube 51, and the other end connected with a junction point $J_2$ between the exhaust gas sensible heat recovery device 53 and the alkaline immersion tank 21 in the solution tube 51. Thus, the alkaline solution that flows through the second solution tube 54 is refluxed into the alkaline immersion tank 21 without passing through the exhaust gas sensible heat recovery device 53 from the circulation pump 52.

The solution-flow-rate adjustment valve 51*a* is disposed between the branch point $J_1$ and the exhaust gas sensible heat recovery device 53 in the solution tube 51, while the solution-flow-rate adjustment valve 54*a* is disposed between the branch point $J_1$ and the junction point $J_2$ in the second solution tube 54. Additionally, the solution-flow-rate adjustment motors 51*b*, 54*b* are each electrically connected with the control device 33. That is, the control device 33 is configured to adjust the corresponding flow rates of the alkaline solutions that flow through the solution tube 51 and the second solution tube 54, by driving the solution-flow-rate adjustment motors 51*b*, 54*b* so as to open or close the solution-flow-rate adjustment valves 51*a*, 54*a*.

For instance, if the detection result detected by the temperature sensor 21*a* is equal to or more than a predetermined value (for instance, a temperature suitable for alkaline cleaning with the alkaline solution), the control device 33 drives the solution-flow-rate adjustment motor 51*b* so as to close the solution-flow-rate adjustment valve 51*a* and drives the solution-flow-rate adjustment motor 54*b* so as to open the solution-flow-rate adjustment valve 54*a*, while driving the circulation pump 52.

With this operation control, the alkaline solution which has been stored in the alkaline immersion tank 21 and enters the solution tube 51 by driving the circulation pump 52 and reaches the branch point $J_1$ does not enter the solution tube 51 (exhaust gas sensible heat recovery device 53) with the closed solution-flow-rate adjustment valve 51*a*, but enters the second solution tube 54 with the open solution-flow-rate adjustment valve 51*a*. Thus, the alkaline solution circulates through the alkaline solution passage 32 (solution tube 51 and second solution tube 54) without passing through the exhaust gas sensible heat recovery device 53, and is thereby not heated by the exhaust gas sensible heat recovery device 53.

On the other hand, if the detection result detected by the temperature sensor 21*a* is less than the predetermined value, the control device 33 drives the solution-flow-rate adjustment motor 51*b* so as to open the solution-flow-rate adjustment valve 51*a* and drives the solution-flow-rate adjustment motor 54*b* so as to close the solution-flow-rate adjustment valve 54*a*, while driving the circulation pump 52.

With this operation control, the alkaline solution which has been stored in the alkaline immersion tank 21 and enters the solution tube 51 by driving the circulation pump 52 and reaches the branch point $J_1$ does not enter the second solution tube 54 with the closed solution-flow-rate adjustment valve 51*a*, but enters the solution tube 51 (exhaust gas sensible heat recovery device 53) with the open solution-flow-rate adjustment valve 51*a*. Thus, the alkaline solution circulates through the alkaline solution passage 32 while passing through the exhaust gas sensible heat recovery device 53, and is thereby heated by the exhaust gas sensible heat recovery device 53.

With the above configuration, it is possible to adjust the corresponding flow rates of the alkaline solutions that flow through the solution tube 51 and the second solution tube 54, i.e., to adjust a ratio between the flow rate of the alkaline solution that enters the exhaust gas sensible heat recovery device 53 in the solution tube 51 and the flow rate of the alkaline solution that flows through the second solution tube 54, by opening or closing the solution-flow-rate adjustment valve 51*a*, 54*a* through the driving of the solution-flow-rate adjustment motor 51*b*, 54*b*.

That is, since the temperature of the alkaline solution can be controlled while driving the circulation pump 52, a possible malfunction caused by repeatedly driving and stopping the circulation pump 52 can be reduced.

Figure 3B:
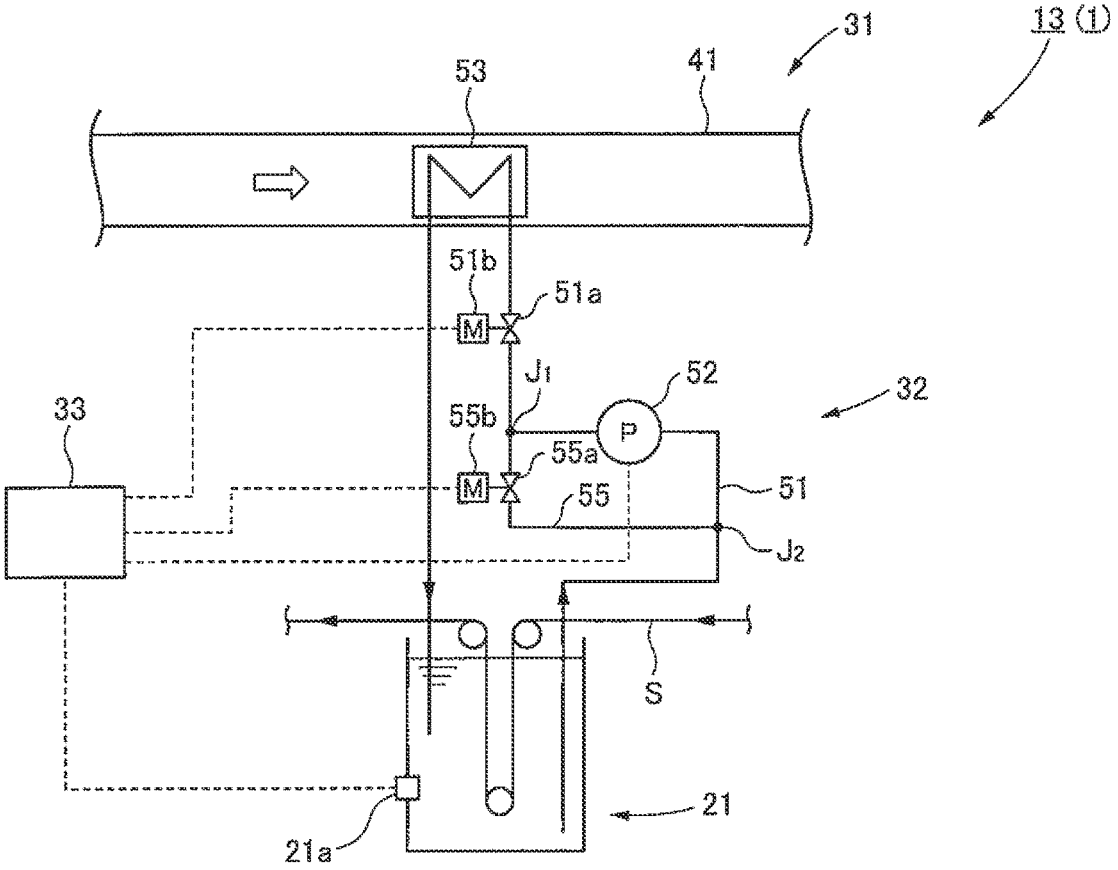
FIG. 3B is an explanatory diagram showing an exemplary configuration in which a solution-flow-rate adjustment unit is provided to an exhaust heat recovery device in continuous annealing equipment according to the first embodiment.

Next, in FIG. 3B, the solution-flow-rate adjustment unit is mainly composed of a second solution tube (bypass flow passage) 55 through which the alkaline solution branched from the solution tube 51 can flow, solution-flow-rate adjustment valves 51*a*, 55*a* capable of adjusting the flow passage areas of the solution tube 51 and the second solution tube 55 (the flow rates of the alkaline solutions that flow through the solution tube 51 and the second solution tube 55), and solution-flow-rate adjustment motors 51*b*, 55*b* for operating (opening or closing) the solution-flow-rate adjustment valves 51*a*, 55*a*.

The second solution tube 54 has one end connected with a branch point $J_1$ between the circulation pump 52 and the exhaust gas sensible heat recovery device 53 in the solution tube 51, and the other end connected with a junction point $J_2$ between the alkaline immersion tank 21 and the circulation pump 52 in the solution tube 51. Thus, the alkaline solution that flows through the second solution tube 54 is refluxed into the solution tube 51 (at the upstream side in the fluid flow direction of the circulation pump 52) without entering the exhaust gas sensible heat recovery device 53 from the circulation pump 52.

The solution-flow-rate adjustment valve 51*a* is disposed between the branch point $J_1$ and the exhaust gas sensible heat recovery device 53 in the solution tube 51, while the solution-flow-rate adjustment valve 55*a* is disposed between the branch point $J_1$ and the junction point 32 in the second solution tube 55. Additionally, the solution-flow-rate adjustment motors 51*b*, 55*b* are each electrically connected with the control device 33. Thus, the control device 33 can drive the solution-flow-rate adjustment motor 51*b*, 55*b* to open or close the solution-flow-rate adjustment valve 51*a*, 55*a*, thereby adjusting the corresponding flow rates of the alkaline solutions that flow through the solution tube 51 and the second solution tube 55.

With the above configuration, the same effects and results can be obtained as in the above-described solution-flow-rate adjustment unit (see FIG. 3A).

While the present embodiment has been described in conjunction with the case where the open/close state and the opening degree of the valves (solution-flow-rate adjustment valve 51*a*, solution-flow-rate adjustment valve 54*a*, solution-flow-rate adjustment valve 55*a*) are adjusted by means of the electric motors (solution-flow-rate adjustment motor 51*b*, solution-flow-rate adjustment motor 54*b*, solution-flow-rate adjustment motor 55*b*), the adjustment of the open/close state and the opening degree of the valves is not limited thereto, and may be performed by means of electromagnet, air pressure, or the like.

Second Embodiment

Figure 4:
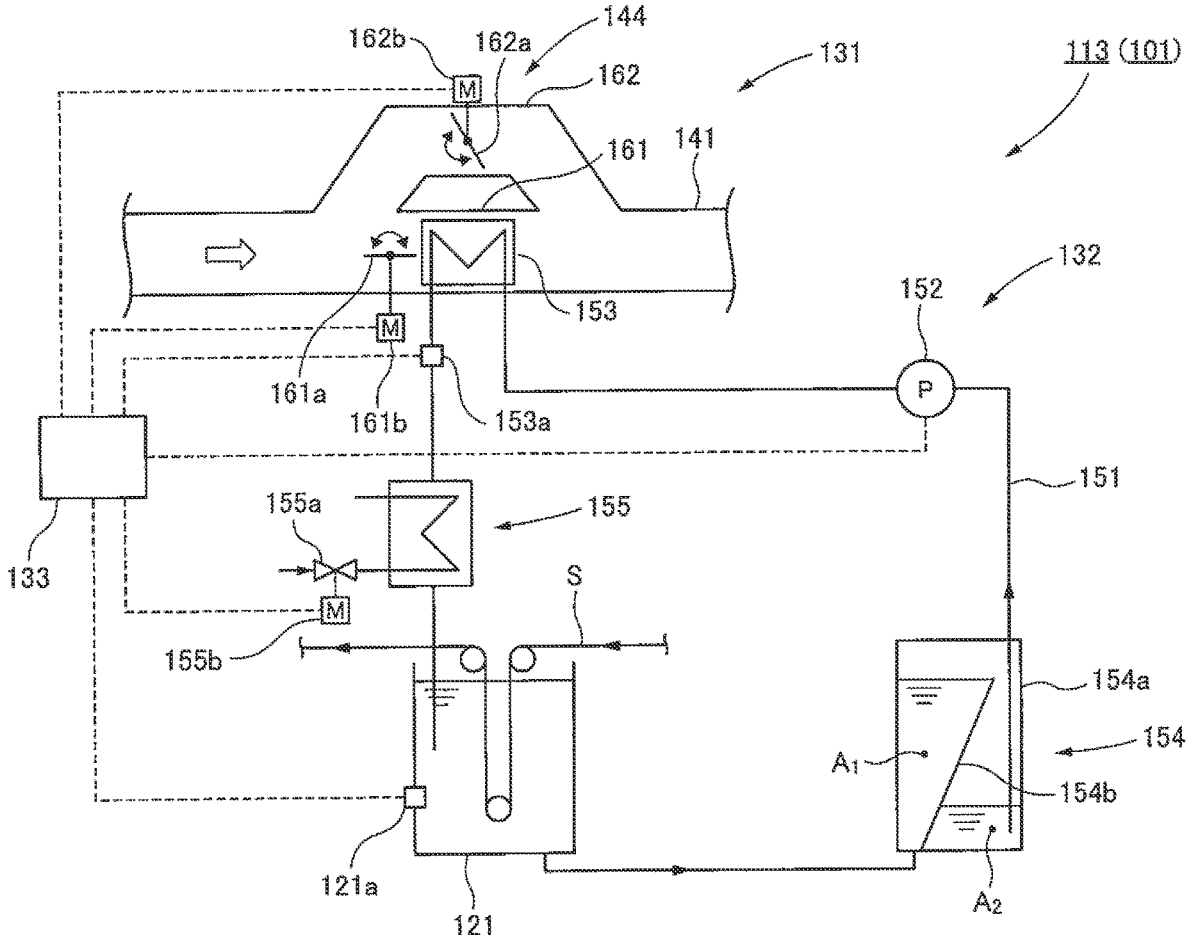
FIG. 4 is an explanatory diagram showing a structure of an exhaust heat recovery device in continuous annealing equipment according to the second embodiment.

With reference to FIG. 4, the structure of the continuous annealing equipment according to the second embodiment of the present invention will now be described.

The continuous annealing equipment 101 according to the present embodiment has the same structure as the continuous annealing equipment 1 according to the first embodiment of the present invention except that an exhaust-gas-flow-rate adjustment mechanism 144 is additionally provided in the exhaust gas passage 131, as well as a sludge removal device 154 and a liquid-heating device 155 are additionally provided in the alkaline solution passage 132. Hence, overlapping explanation about the same structure in the continuous annealing equipment 101 according to the present embodiment as the first embodiment will be omitted.

As shown in FIG. 4, the exhaust-gas-flow-rate adjustment mechanism 144 is mainly composed of two passages (main flow passage 161 and auxiliary flow passage 162) arranged parallel in a portion of the exhaust gas tube 141, exhaust-gas-flow-rate adjustment valves 161*a*, 162*a* capable of adjusting the flow passage areas of the main flow passage 161 and the auxiliary flow passage 162 (the flow rates of the exhaust gases that flow through the main flow passage 161 and the auxiliary flow passage 162), and exhaust-gas-flow-rate adjustment motors 161*b*, 162*b* for operating (opening or closing) the exhaust-gas-flow-rate adjustment valves 161*a*, 162*a*.

The exhaust-gas-flow-rate adjustment motors 161*b*, 162*b* are each electrically connected with the control device 133. That is, the control device 133 is configured to adjust a ratio between the flow rates of the exhaust gases that flow through the main flow passage 161 and the auxiliary flow passage 162, by driving the exhaust-gas-flow-rate adjustment motors 161*b*, 162*b* so as to open or close the exhaust-gas-flow-rate adjustment valves 162*a*, 162*b*.

Additionally, the exhaust gas sensible heat recovery device 153 is located in the main flow passage 161 in the exhaust gas tube 141 and contacts with the exhaust gas that flows through the main flow passage 161. Thus, the alkaline solution that passes through the exhaust gas sensible heat recovery device 153 can be heated by using the exhaust gas that flows the main flow passage 161 as a heat source.

As shown in FIG. 4, the sludge removal device 154 serves to remove sludge contained in the alkaline solution that flows through the alkaline solution passage 132 (alkaline solution tube 151) and is disposed, between the alkaline immersion tank 121 and the circulation pump 152, upstream of the circulation pump 152 in the solution flow direction.

The sludge removal device 154 includes a sludge removal vessel 154*a* for temporarily storing the alkaline solution and a sludge removal weir 154*b* for dividing a space inside the sludge removal vessel 154*a*. In the alkaline solution passage 132, the alkaline solution enters from the alkaline immersion tank 121 into one side, a space $A_1$ (the left side in FIG. 4), of the sludge removal vessel 154*a* divided by the sludge removal weir 154*b* and overflows from the space $A_1$ at one side to the other side, a space $A_2$ (the right side in FIG. 4), of the sludge removal vessel 154*a* divided by the sludge removal weir 154*b*, flowing into the circulation pump 152.

That is, the sludge contained in the alkaline solution sinks in the space $A_1$ at one side, and the alkaline solution from which the sludge is removed is stored in the space $A_2$ at the other side. In this way, when the sludge removal device 154 is disposed upstream of the circulation pump 152 in the solution flow direction, the alkaline solution from which the sludge is removed can flow through the circulation pump 152, whereby it is possible to prevent damage to the circulation pump 152 and clogging of fluid passages (e.g., tubes, not shown) in the heat exchangers 153, 155, due to the sludge.

As shown in FIG. 4, the liquid-heating device 155 serves as a heat exchanger (heater) using a high-temperature gas (or hot water) other than the exhaust gas discharged from the annealing device 112 as a heat source and is disposed, between the exhaust gas sensible heat recovery device 153 and the alkaline immersion tank 121, downstream of the exhaust gas sensible heat recovery device 153 in the solution flow direction.

The liquid-heating device 155 includes a high-temperature-gas-flow-rate adjustment valve 155*a* capable of adjusting the flow rate of the high-temperature gas used as the heat source and a high-temperature-gas-flow-rate adjustment motor 155*b* for operating (opening or closing) the high-temperature-gas-flow-rate adjustment valve 155*a*.

The high-temperature-gas-flow-rate adjustment motor 155*b* is electrically connected with the control device 133. That is, the control device 133 is configured to adjust the flow rate of the high-temperature gas that flows through the liquid-heating device 155, by driving the high-temperature-gas-flow-rate adjustment motor 155*b* so as to open or close the high-temperature-gas-flow-rate adjustment valve 155*a*.

Of course, the liquid-heating device in the present invention may be any device that can heat the alkaline solution aside from the exhaust gas sensible heat recovery device 153 and is not limited to the liquid-heating device 155 in the present embodiment. The liquid-heating device in the present invention may be, for instance, an electric heater.

Additionally, the control device 133 is electrically connected with a temperature sensor 121*a* provided in the alkaline immersion tank 121 and with a temperature sensor 153*a* provided downstream of the exhaust gas sensible heat recovery device 153 in the solution flow direction, in the alkaline solution passage 132 (alkaline solution tube 151). Herein, the temperature sensor 121*a* represents a device for detecting the temperature of the alkaline solution stored in the alkaline immersion tank 121, while the temperature sensor 153*a* represents a device for detecting the temperature of the alkaline solution that flows out from the exhaust gas sensible heat recovery device 153.

Detection results (the temperature of the alkaline solution stored in the alkaline immersion tank 121 and the temperature of the alkaline solution that flows out from the exhaust gas sensible heat recovery device 153) detected by the temperature sensor 121*a* and the temperature sensor 153*a* are transmitted to the control device 133, and the control device 133 controls operations of the circulation pump 152, the exhaust-gas-flow-rate adjustment motors 161*b*, 162*b*, and the high-temperature-gas-flow-rate adjustment motor 155*b*, based on the detection results.

With reference to FIG. 4, an operation of the continuous annealing equipment according to the second embodiment of the present invention will be described.

In the step of continuous annealing treatment by the continuous annealing equipment 101, the control device 133 controls an operation of the circulation pump 152, based on a detection result (the temperature of the alkaline solution stored in the alkaline immersion tank 121) detected by the temperature sensor 121*a* (see FIG. 4).

More specifically, if the detection result detected by the temperature sensor 121*a* is equal to or more than a predetermined value (for instance, a temperature suitable for alkaline cleaning with the alkaline solution), the control device 133 does not drive the circulation pump 152; whereas if the detection result detected by the temperature sensor 121*a* is less than the predetermined value, the control device 133 drives the circulation pump 152.

Subsequently, in the case that the circulation pump 152 is driven, the control device 133 controls operations of the exhaust-gas-flow-rate adjustment motors 161*b*, 162*b* and the high-temperature-gas-flow-rate adjustment motor 155*b*, based on a detection result (the temperature of the alkaline solution that flows out from the exhaust gas sensible heat recovery device 153) detected by the temperature sensor 153*a*.

More specifically, if the detection result detected by the temperature sensor 153*a* is equal to or more than a predetermined value (for instance, the boiling point of the alkaline solution), the control device 133 drives the exhaust-gas-flow-rate adjustment motor 162*b* so as to open the exhaust-gas-flow-rate adjustment valve 162*a* so that the exhaust gas flows through not only the main flow passage 161 but also the auxiliary flow passage 162 in the exhaust gas tube 141.

This operation control causes the exhaust gas that flows through the exhaust gas tube 141 to partially flow through the auxiliary flow passage 162 and reduces the flow rate of the exhaust gas that flows through the main flow passage 161, thereby preventing an increase in temperature of the alkaline solution heated by heat exchanging in the exhaust gas sensible heat recovery device 153.

Additionally, when it is required to further prevent an increase in temperature of the alkaline solution, the control device 133 drives the exhaust-gas-flow-rate adjustment motor 161*b* so as to close the exhaust-gas-flow-rate adjustment valve 161*a*, thereby reducing the flow rate of the exhaust gas that flows through the main flow passage 161. This operation control can further prevent an increase in temperature of the alkaline solution heated by heat exchanging in the exhaust gas sensible heat recovery device 153.

On the other hand, if the detection result detected by the temperature sensor 153*a* is less than a predetermined value (for instance, a temperature suitable for alkaline cleaning with the alkaline solution), the control device 133 drives the exhaust-gas-flow-rate adjustment motor 161*b* so as to open the exhaust-gas-flow-rate adjustment valve 161*a* so that the flow rate of the exhaust gas that flows through the main flow passage 161 is increased. This operation control can promote an increase in temperature of the alkaline solution heated by heat exchanging in the exhaust gas sensible heat recovery device 153.

Additionally, when it is required to further promote an increase in temperature of the alkaline solution, the control device 133 drives the exhaust-gas-flow-rate adjustment motor 162*b* so as to close the exhaust-gas-flow-rate adjustment valve 162*a* and reduces the flow rate of the exhaust gas that flows through the auxiliary flow passage 162, thereby increasing the flow rate of the exhaust gas that flows through the main flow passage 161. This operation control can further promote an increase in temperature of the alkaline solution heated by heat exchanging in the exhaust gas sensible heat recovery device 153.

Additionally, when it is required to further increase the temperature of the alkaline solution, the control device 133 drives the high-temperature-gas-flow-rate adjustment motor 155*b* so as to open the high-temperature-gas-flow-rate adjustment valve 155*a* and activates the liquid-heating device 155. This operation control can heat the alkaline solution that flows out from the exhaust gas sensible heat recovery device 153 (and is refluxed into the alkaline immersion tank 121) by heat exchanging in the liquid-heating device 155.

As described above, with the continuous annealing equipment 101 according to the present embodiment, the following effects and results can be obtained in addition to the effects and results by the continuous annealing equipment 1 according to the first embodiment.

First, the exhaust-gas-flow-rate adjustment mechanism 144 additionally provided in the exhaust gas passage 131 makes it possible to adjust a ratio between the flow rates of the exhaust gases that flow through the main flow passage 161 and the auxiliary flow passage 162 and thereby adjust heating of the alkaline solution by the exhaust gas while preventing overheating of the alkaline solution.

Moreover, the sludge removal device 154 additionally provided in the alkaline solution passage 132 makes it possible to prevent damage to the circulation pump 152 and clogging of fluid passages (e.g., tubes, not shown) in the heat exchangers 153, 155, due to the sludge.

Moreover, the liquid-heating device 155 additionally provided in the alkaline solution passage 132 makes it possible to compensate for a lack of heat quantity for heating the alkaline solution with the exhaust gas.

In this context, a heat exchanger (second heat exchanger) capable of switching between a cooling medium and a heating medium as a heat source fluid may be provided as means for compensating for a lack of heat quantity for heating the alkaline solution while preventing overheating of the alkaline solution. When such a heat exchanger capable of switching between a cooling medium and a heating medium is provided, it is unnecessary to provide a liquid-cooling device and a liquid-heating device. Thus, the continuous annealing equipment can be downsized.

While the present embodiment has been described in conjunction with the case where the open/close state and the opening degree of the valves (exhaust-gas-flow-rate adjustment valves 161*a*, 162*a*, high-temperature-gas-flow-rate adjustment valve 155*a*) are adjusted by driving the electric motors (exhaust-gas-flow-rate adjustment motors 161*b*, 162*b*, high-temperature-gas-flow-rate adjustment motor 155*b*), the adjustment of the open/close state and the opening degree of the valves is not limited thereto, and may be performed by means of electromagnet, air pressure, or the like.

Third Embodiment

Figure 5:
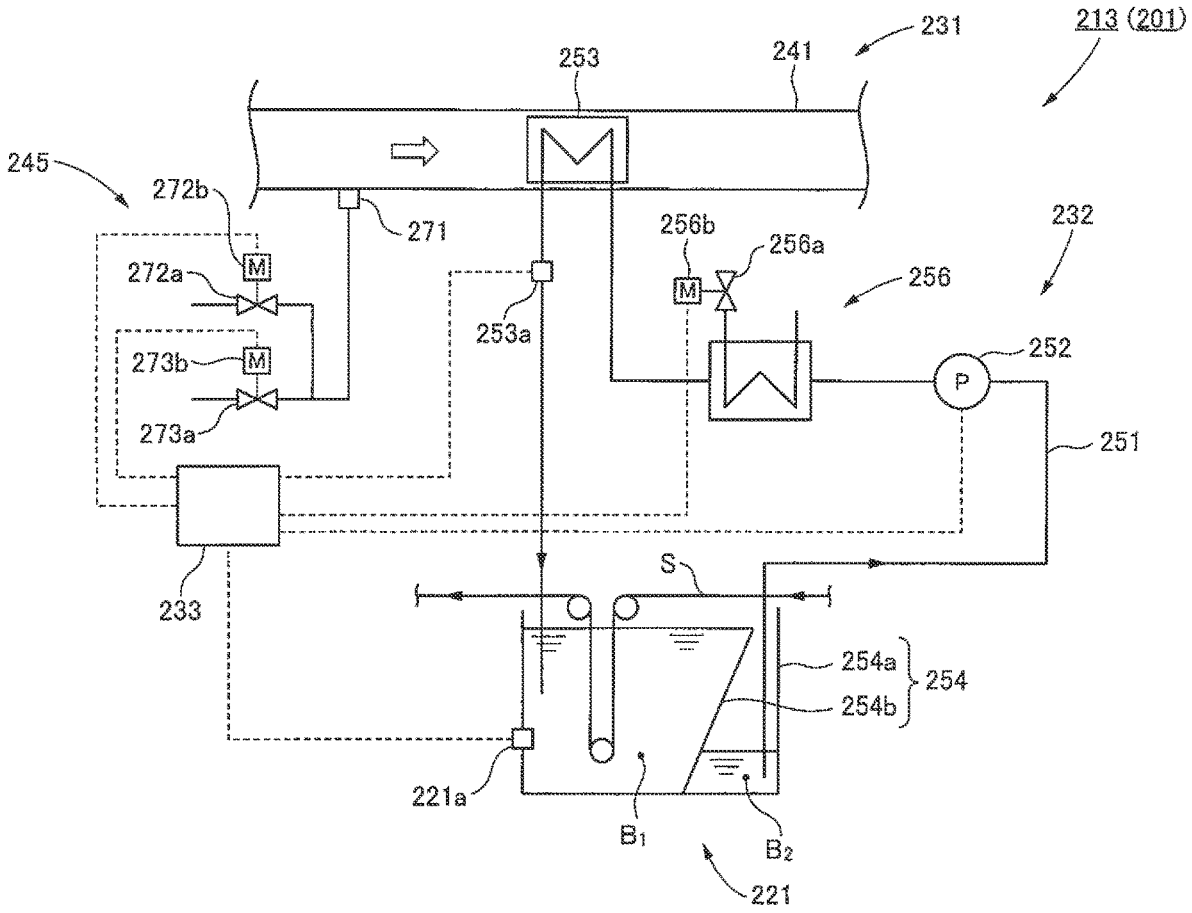
FIG. 5 is an explanatory diagram showing a structure of an exhaust heat recovery device in continuous annealing equipment according to the third embodiment.

With reference to FIG. 5, the structure of the continuous annealing equipment according to the third embodiment of the present invention will now be described.

The continuous annealing equipment 201 according to the present embodiment has the same structure as the continuous annealing equipment 1 according to the first embodiment of the present invention except that an air-flow-heating device 245 is additionally provided in the exhaust gas passage 231, a liquid-cooling device 256 is additionally provided in the alkaline solution passage 232, and further a sludge removal mechanism 254 is added in the alkaline immersion tank 221. Hence, overlapping explanation about the same structure in the continuous annealing equipment 201 according to the present embodiment as the first embodiment will be omitted.

As shown in FIG. 5, the air-flow-heating device 245 is mainly composed of an auxiliary burner (ignition part) 271 provided in the exhaust gas tube 241, a combustion-gas-flow-rate adjustment valve 272*a* and an air-flow-rate adjustment valve 273*a* capable of adjusting the amount of combustion gas and air to be supplied to the auxiliary burner 271, and a combustion-gas-flow-rate adjustment motor 272*b* and an air-flow-rate adjustment motor 273*b* for operating (opening or closing) the combustion-gas-flow-rate adjustment valve 272*a* and the air-flow-rate adjustment valve 273*a*.

The auxiliary burner 271, the combustion-gas-flow-rate adjustment motor 272*b*, and the air-flow-rate adjustment motor 273*b* are each electrically connected with the control device 233. That is, the control device 233 is configured to heat the exhaust gas that flows through the exhaust gas tube 241, by driving the combustion-gas-flow-rate adjustment motor 272*b* and the air-flow-rate adjustment motor 273*b* so as to open the combustion-gas-flow-rate adjustment valve 272*a* and the air-flow-rate adjustment valve 273*a* while operating the auxiliary burner 271 so as to ignite an air-fuel mixture of the supplied combustion gas and air.

Additionally, the control device 233 is configured to adjust heating of the exhaust gas with the air-flow-heating device 245 (auxiliary burner 271), by driving the combustion-gas-flow-rate adjustment motor 272*b* and the air-flow-rate adjustment motor 273*b* so as to open or close the combustion-gas-flow-rate adjustment valve 272*a* and the air-flow-rate adjustment valve 273*a*.

As shown in FIG. 5, the liquid-cooling device 256 serves as a heat exchanger (cooler) using a low-temperature gas (or cold water) as a heat source and is disposed, between the circulation pump 252 and the exhaust gas sensible heat recovery device 253, upstream of the exhaust gas sensible heat recovery device 253 in the solution flow direction.

The liquid-cooling device 256 includes a low-temperature-gas-flow-rate adjustment valve 256*a* capable of adjusting the flow rate of the low-temperature gas used as the heat source and a low-temperature-gas-flow-rate adjustment motor 256*b* for operating (opening or closing) the low-temperature-gas-flow-rate adjustment valve 256*a*.

Of course, the liquid-cooling device in the present invention may be any device that can cool the alkaline solution entering the exhaust gas sensible heat recovery device 253 and is not limited to the liquid-cooling device 256 in the present embodiment.

The low-temperature-gas-flow-rate adjustment motor 256*b* is electrically connected with the control device 233. That is, the control device 233 is configured to adjust the flow rate of the low-temperature gas that flows through the liquid-cooling device 256, by driving the low-temperature-gas-flow-rate adjustment motor 256*b* so as to open or close the low-temperature-gas-flow-rate adjustment valve 256*a*.

Additionally, the control device 233 is electrically connected with a temperature sensor 221*a* provided in the alkaline immersion tank 221 and with a temperature sensor 253*a* provided downstream of the exhaust gas sensible heat recovery device 253 in the solution flow direction, in the alkaline solution passage 232 (alkaline solution tube 251). Herein, the temperature sensor 221*a* represents a device for detecting the temperature of the alkaline solution stored in the alkaline immersion tank 221, while the temperature sensor 253*a* represents a device for detecting the temperature of the alkaline solution that flows out from the exhaust gas sensible heat recovery device 253.

Detection results (the temperature of the alkaline solution stored in the alkaline immersion tank 221 and the temperature of the alkaline solution that flows out from the exhaust gas sensible heat recovery device 253) detected by the temperature sensor 221*a* and the temperature sensor 253*a* are transmitted to the control device 233, and the control device 233 controls operations of the circulation pump 252, the auxiliary burner 271, the combustion-gas-flow-rate adjustment motor 272*b*, the air-flow-rate adjustment motor 273*b*, and the low-temperature-gas-flow-rate adjustment motor 256*b*, based on the detection results.

Moreover, as shown in FIG. 5, the sludge removal mechanism 254 provided in the alkaline immersion tank 221 serves to remove sludge contained in the alkaline solution that flows through the alkaline solution passage 232 (alkaline solution tube 251).

The alkaline immersion tank 221 includes an alkaline vessel 254*a* for temporarily storing the alkaline solution and a sludge removal weir 254*b* for dividing a space inside the alkaline vessel 254*a*. The alkaline solution refluxed from the alkaline solution passage 232 enters into one side, a space $B_1$ (the left side in FIG. 5), of the alkaline vessel 254*a* divided by the sludge removal weir 254*b* and overflows from the space $B_1$ at one side to the other side, a space $B_2$ (the right side in FIG. 5), of the sludge removal vessel 254*a* divided by the sludge removal weir 254*b*, flowing into the circulation pump 252. In this section, the steel strip S is fed to the space $B_1$ at one side of the alkaline vessel 254*a* and is immersed in the alkaline solution stored in the space $B_1$ at one side.

That is, the sludge contained in the alkaline solution sinks in the space $B_1$ at one side, and the alkaline solution from which the sludge is removed is stored in the space $B_2$ at the other side. In this way, when the alkaline immersion tank 221 is provided with the sludge removal mechanism 254, the alkaline solution from which the sludge is removed can flow through the circulation pump 252, whereby it is possible to prevent damage to the circulation pump 252 and clogging of fluid passages (e.g., tubes, not shown) in the heat exchangers 253, 256, due to the sludge.

With reference to FIG. 5, an operation of the continuous annealing equipment according to the third embodiment of the present invention will be described.

In the step of continuous annealing treatment by the continuous annealing equipment 201, the control device 233 controls an operation of the circulation pump 252, based on a detection result (the temperature of the alkaline solution stored in the alkaline immersion tank 221) detected by the temperature sensor 221*a* (see FIG. 5).

More specifically, if the detection result detected by the temperature sensor 221*a* is equal to or more than a predetermined value (for instance, a temperature suitable for alkaline cleaning with the alkaline solution), the control device 233 does not drive the circulation pump 252; whereas if the detection result detected by the temperature sensor 221*a* is less than the predetermined value, the control device 233 drives the circulation pump 252.

Subsequently, in the case that the circulation pump 252 is driven, the control device 233 controls operations of the auxiliary burner 271, the combustion-gas-flow-rate adjustment motor 272*b*, the air-flow-rate adjustment motor 273*b*, and the low-temperature sensor-gas flow-rate adjustment motor 256*b*, based on a detection result (the temperature of the alkaline solution that flows out from the exhaust gas sensible heat recovery device 253) detected by the temperature sensor 253*a*.

More specifically, if the detection result detected by the temperature sensor 253*a* is equal to or more than a predetermined value (for instance, the boiling point of the alkaline solution), the control device 233 drives the low-temperature-gas-flow-rate adjustment motor 256*b* so as to open the low-temperature-gas-flow-rate adjustment valve 256*a* and thereby activates the liquid-cooling device 256. This operation control causes the alkaline solution that enters the exhaust gas sensible heat recovery device 253 to be cooled by heat exchanging in the liquid-cooling device 256, thereby preventing overheating (e.g., boiling) of the alkaline solution.

On the other hand, if the detection result detected by the temperature sensor 253*a* is less than a predetermined value (for instance, a temperature suitable for alkaline cleaning with the alkaline solution), the control device 233 drives the combustion-gas-flow-rate adjustment motor 272*b* and the air-flow-rate adjustment motor 273*b* so as to open the combustion-gas-flow-rate adjustment valve 272*a* and the air-flow-rate adjustment valve 273*a* while operating the auxiliary burner 271 so as to ignite an air-fuel mixture of the supplied combustion gas and air, thereby heating the exhaust gas that flows through the exhaust gas tube 241. This operation control can promote an increase in temperature of the alkaline solution heated by heat exchanging in the exhaust gas sensible heat recovery device 253.

As described above, with the continuous annealing equipment 201 according to the present embodiment, the following effects and results can be obtained in addition to the same effects and results as the continuous annealing equipment 1 according to the first embodiment.

First, the air-flow-heating device 245 additionally provided in the exhaust gas passage 231 makes it possible to compensate for a lack of heat quantity for heating the alkaline solution with the exhaust gas as well as to heat the exhaust gas and thus the alkaline solution even at the start of operating the continuous annealing equipment 201.

Moreover, the liquid-cooling device 256 additionally provided in the alkaline solution passage 232 makes it possible to prevent overheating of the alkaline solution by the exhaust gas.

Moreover, the sludge removal device added to the alkaline immersion tank 221 makes it possible to prevent damage to the circulation pump 252 and clogging of fluid passages (e.g., tubes, not shown) in the heat exchangers 253, 256, due to the sludge.

In this context, a heat exchanger (second heat exchanger) capable of switching between a cooling medium and a heating medium as a heat source fluid may be provided as means for compensating for a lack of heat quantity for heating the alkaline solution while preventing overheating of the alkaline solution. When such a heat exchanger capable of switching between a cooling medium and a heating medium is provided, it is unnecessary to provide a liquid-cooling device and a liquid-heating device. Thus, the continuous annealing equipment can be downsized.

While the present embodiment has been described in conjunction with the case where the open/close state and the opening degree of the valves (combustion-gas-flow-rate adjustment valve 272*a*, air-flow-rate adjustment valve 273*a*, low-temperature-gas-flow-rate adjustment valve 256*a*) are adjusted by driving the electric motors (combustion-gas-flow-rate adjustment motor 272*b*, air-flow-rate adjustment motor 273*b*, low-temperature-gas-flow-rate adjustment motor 256*b*), the adjustment of the open/close state and the opening degree of the valves is not limited thereto, and may be performed by means of electromagnet, air pressure, or the like.

REFERENCE SIGNS LIST

1 Continuous annealing equipment
11 Pre-cleaning device (Cleaning device)
12 Annealing device (Annealing furnace)
13 Exhaust heat recovery device
21 Alkaline immersion tank (Cleaning device, Cleaning solution tank)
21*a* Temperature sensor
22 Brush scrubber
23 Alkaline electrolytic cleaning tank
24 Brush scrubber
25 Rinse tank
26 Ringer roll
27 Dryer
31 Exhaust gas passage
32 Alkaline solution passage (Solution circulation passage)
33 Control device
41 Exhaust gas tube (Exhaust gas passage)
42 Exhaust gas fan
43 Stack
51 Alkaline solution tube (Solution circulation passage)
51*a* Solution-flow-rate adjustment valve (Solution-flow-rate adjustment unit)
51*b* Solution-flow-rate adjustment motor (Solution-flow-rate adjustment unit)
52 Circulation pump
53 Exhaust gas sensible heat recovery device (Heat exchanger)
54 Second solution tube (Solution-flow-rate adjustment unit, Solution flow passage)
54*a* Solution-flow-rate adjustment valve (Solution-flow-rate adjustment unit)
54*b* Solution-flow-rate adjustment motor (Solution-flow-rate adjustment unit)
55 Second solution tube (Solution-flow-rate adjustment unit, Solution flow passage)
55*a* Solution-flow-rate adjustment valve (Solution-flow-rate adjustment unit)
55*b* Solution-flow-rate adjustment motor (Solution-flow-rate adjustment unit)
101 Continuous annealing equipment
113 Exhaust heat recovery device
121 Alkaline immersion tank (Cleaning device, Cleaning solution tank)
121*a* Temperature sensor
131 Exhaust gas passage
132 Alkaline solution passage (Solution circulation passage)
133 Control device
141 Exhaust gas tube (Exhaust gas passage)
144 Exhaust-gas-flow-rate adjustment mechanism
151 Alkaline solution tube (Solution circulation passage)
152 Circulation pump
153 Exhaust gas sensible heat recovery device (Heat exchanger)
153*a* Temperature sensor (Second temperature sensor)
154 Sludge removal device
154*a* Sludge removal vessel (Sludge removal device)
154*b* Sludge removal weir (Sludge removal device)
155 Liquid-heating device
155*a* High-temperature-gas-flow-rate adjustment valve (Liquid-heating device)
155*b* High-temperature-gas-flow-rate adjustment motor (Liquid-heating device)
161 Main flow passage (First flow passage)
161*a* Exhaust-gas-flow-rate adjustment valve (Exhaust-gas-flow-rate adjustment mechanism)
161*b* Exhaust-gas-flow-rate adjustment motor (Exhaust-gas-flow-rate adjustment mechanism)
162 Auxiliary flow passage (Second flow passage)
162*a* Exhaust-gas-flow-rate adjustment valve (Exhaust-gas-flow-rate adjustment mechanism)
162*b* Exhaust-gas-flow-rate adjustment motor (Exhaust-gas-flow-rate adjustment mechanism)
201 Continuous annealing equipment
213 Exhaust heat recovery device
221 Alkaline immersion tank (Cleaning device, Cleaning solution tank)
221*a* Temperature sensor
231 Exhaust gas passage
232 Alkaline solution passage (Solution circulation passage)
233 Control device
241 Exhaust gas tube (Exhaust gas passage)
245 Air-flow-heating device
251 Alkaline solution tube (Solution circulation passage)
252 Circulation pump
253 Exhaust gas sensible heat recovery device (Heat exchanger)
253*a* Temperature sensor (Second temperature sensor)
254 Sludge removal mechanism (Sludge removal device)
254*a* Alkaline vessel (Sludge removal device)
254*b* Sludge removal weir (Sludge removal device)
256 Liquid-cooling device
256*a* Low-temperature-gas-flow-rate adjustment valve (Liquid-cooling device)
256*b* Low-temperature-gas-flow-rate adjustment motor (Liquid-cooling device)
271 Auxiliary burner (Air-flow-heating device)
272*a* Combustion-gas-flow-rate adjustment valve (Air-flow-heating device)
272*b* Combustion-gas-flow-rate adjustment motor (Air-flow-heating device)
273*a* Air-flow-rate adjustment valve (Air-flow-heating device)
273*b* Air-flow-rate adjustment motor (Air-flow-heating device)
S Steel strip

The invention claimed is:

1. Continuous annealing equipment including a cleaning device for performing a cleaning treatment on a steel strip and an annealing device for performing an annealing treatment on the steel strip, the continuous annealing equipment comprising;

an exhaust gas passage through which an exhaust gas discharged from the annealing device flows;

a solution circulation passage through which a cleaning solution used in the cleaning device circulates; and a heat exchanger which forms a part of the solution circulation passage and contacts with the exhaust gas, wherein the heat exchanger is disposed in the exhaust gas passage or constituted on a wall surface of the exhaust gas passage, wherein the continuous annealing equipment comprises:

a cleaning solution tank for storing the cleaning solution;

a circulation pump configured to circulate the cleaning solution from the cleaning solution tank through the solution circulation passage;

a temperature sensor configured to detect a temperature of the cleaning solution stored in the cleaning solution tank;

a control device configured to control an operation of the circulation pump, based on a detection result detected by the temperature sensor; and a solution-flow-rate adjustment unit capable of adjusting a flow rate of the cleaning solution supplied to the heat exchanger by the circulation pump, wherein the control device is configured to control an operation of the solution-flow-rate adjustment unit, wherein the solution-flow-rate adjustment unit includes:

a solution flow passage which allows the cleaning solution to bypass the heat exchanger and flow in the solution circulation passage; and a solution-flow-rate adjustment valve capable of adjusting a ratio between a flow rate of the cleaning solution entering the heat exchanger in the solution circulation passage and a flow rate of the cleaning solution flowing through the solution flow passage.

2. Continuous annealing equipment including a cleaning device for performing a cleaning treatment on a steel strip and an annealing device for performing an annealing treatment on the steel strip, the continuous annealing equipment comprising:

an exhaust gas passage through which an exhaust gas discharged from the annealing device flows;

a solution circulation passage through which a cleaning solution used in the cleaning device circulates; and a heat exchanger which forms a part of the solution circulation passage and contacts with the exhaust gas, wherein the heat exchanger is disposed in the exhaust gas passage or constituted on a wall surface of the exhaust gas passage, wherein the continuous annealing equipment comprises:

a cleaning solution tank for storing the cleaning solution;

a circulation pump configured to circulate the cleaning solution from the cleaning solution tank through the solution circulation passage;

a temperature sensor configured to detect a temperature of the cleaning solution stored in the cleaning solution tank;

a control device configured to control an operation of the circulation pump, based on a detection result detected by the temperature sensor;

a first flow passage which forms a part of the exhaust gas passage and in which the heat exchanger is disposed;

a second flow passage which forms a part of the exhaust gas passage and is arranged parallel to the first flow passage; and an exhaust-gas-flow-rate adjustment mechanism capable of adjusting a ratio between a flow rate of the exhaust gas flowing through the first flow passage and a flow rate of the exhaust gas flowing through the second flow passage, wherein the control device is configured to control an operation of the exhaust-gas-flow-rate adjustment mechanism.

3. Continuous annealing equipment including a cleaning device for performing a cleaning treatment on a steel strip and an annealing device for performing an annealing treatment on the steel strip, the continuous annealing equipment comprising:

an exhaust gas passage through which an exhaust gas discharged from the annealing device flows: a solution circulation passage through which a cleaning solution used in the cleaning device circulates; and a heat exchanger which forms a part of the solution circulation passage and contacts with the exhaust gas, wherein the heat exchanger is disposed in the exhaust gas passage or constituted on a wall surface of the exhaust gas passage, wherein the continuous annealing equipment comprises:

a cleaning solution tank for storing the cleaning solution;

a circulation pump configured to circulate the cleaning solution from the cleaning solution tank through the solution circulation passage;

a temperature sensor configured to detect a temperature of the cleaning solution stored in the cleaning solution tank;

a control device configured to control an operation of the circulation pump, based on a detection result detected by the temperature sensor; and a temperature adjustment device including: a liquid-heating device capable of heating the cleaning solution flowing through the solution circulation passage; or a liquid-cling device capable of cooling the cleaning solution flowing through the solution circulation passage, wherein the control device is configured to control an operation of the temperature adjustment device.

4. The continuous annealing equipment according to claim 3, wherein the liquid-heating device is disposed downstream of the heat exchanger in the solution circulation passage in a flow direction of the cleaning solution.

5. The continuous annealing equipment according to claim 3, wherein the liquid-cooling device is disposed upstream of the heat exchanger in the solution circulation passage in a flow direction of the cleaning solution.

6. The continuous annealing equipment according to claim 3, further comprising a second heat exchanger capable of switchably using a cooling medium and a heating medium as a heat source fluid to heat or cool the cleaning solution flowing through the solution circulation passage, wherein the control device is configured to control an operation of the second heat exchanger.

7. Continuous annealing equipment including a cleaning device for performing a cleaning treatment on a steel strip and an annealing device for performing an annealing treatment on the steel strip, the continuous annealing equipment comprising:

an exhaust gas passage through which an exhaust gas discharged from the annealing device flows; a solution circulation passage through which a cleaning solution used in the cleaning device circulates; and a heat exchanger which forms a part of the solution circulation passage and contacts with the exhaust gas, wherein the heat exchanger is disposed in the exhaust gas passage or constituted on a wall surface of the exhaust gas passage, wherein the continuous annealing equipment comprises:

a cleaning solution tank for storing the cleaning solution;

a circulation pump configured to circulate the cleaning solution from the cleaning solution tank through the solution circulation passage;

a temperature sensor configured to detect a temperature of the cleaning solution stored in the cleaning solution tank;

a control device configured to control an operation of the circulation pump, based on a detection result detected by the temperature sensor; and an air-flow-heating device disposed upstream of the heat exchanger in the exhaust gas passage in a flow direction of the exhaust gas and capable of heating the exhaust gas flowing though the exhaust gas passage, wherein the control device is configured to control an operation of the air-flow-heating device.

8. The continuous annealing equipment according to claim 1, further comprising a sludge removal device disposed upstream of the circulation pump in the solution circulation passage in a flow direction of the cleaning solution and capable of removing sludge contained in the cleaning solution.

9. The continuous annealing equipment according to claim 1, further comprising a second temperature sensor disposed downstream of the heat exchanger in the solution circulation passage in a flow direction of the cleaning solution and configured to detect a temperature of the cleaning solution flowing through the solution circulation passage, wherein the control device is configured to perform an operation control, based on a detection result detected by the second temperature sensor.

* * * * *